US005553811A

United States Patent [19]

Hahm et al.

[11] Patent Number: 5,553,811

[45] Date of Patent: Sep. 10, 1996

[54] LAP CREEL

[76] Inventors: Manfred Hahm; Jürgen Hahm, both of Caral-Siedlung 8, 52070 Aachen, Germany

[21] Appl. No.: 256,641

[22] PCT Filed: Jan. 16, 1993

[86] PCT No.: PCT/EP93/00096

§ 371 Date: Aug. 15, 1994

§ 102(e) Date: Aug. 15, 1994

[87] PCT Pub. No.: WO93/15013

PCT Pub. Date: Aug. 5, 1993

[30] Foreign Application Priority Data

Jan. 25, 1992 [DE] Germany ..... 42 02 029.8

[51] Int. Cl.[6] ..... B65H 75/18; B65H 75/10; D06F 17/00

[52] U.S. Cl. ..... 242/605; 68/198; 242/118.11; 242/118.3

[58] Field of Search ..... 242/605, 118.11, 242/118.1, 118.3, 118.31; 68/198, 189

[56] References Cited

U.S. PATENT DOCUMENTS

| | | | |
|---|---|---|---|
| 3,402,902 | 9/1968 | Schmidt | 242/118.31 |
| 4,379,529 | 4/1983 | Nielsen | 242/118.11 |
| 4,946,114 | 8/1990 | Becker et al. | 242/118.1 |
| 5,354,008 | 10/1994 | Honegger | 242/605 X |

FOREIGN PATENT DOCUMENTS

| | | | |
|---|---|---|---|
| 0201826 | 11/1986 | European Pat. Off. . | |
| 0268565 | 5/1988 | European Pat. Off. . | |
| 0376139 | 7/1990 | European Pat. Off. . | |
| 0472507 | 2/1992 | European Pat. Off. . | |
| 0471353 | 2/1992 | European Pat. Off. | 242/118.11 |
| 1785485 | 7/1971 | Germany . | |
| 3909979 | 9/1990 | Germany . | |
| 8002832 | 12/1980 | WIPO . | |
| 0513904 | 11/1992 | WIPO . | |

*Primary Examiner*—Michael R. Mansen
*Attorney, Agent, or Firm*—Fish & Richardson P.C.

[57] ABSTRACT

The invention concerns a yarn bobbin with a rotationally symmetrical body the outside of which forms a surface which carries the yarn and which has a longitudinally protruding collar at one end. The aim of the invention is to design a bobbin of this kind which has the advantages of prior art bobbins but which, when wound, can be stacked with other, similar, bobbins without the yarn being damaged or snagged. The invention achieves this by virtue of the fact that the bobbin has, at its end with the yarn uptake, an additional collar which has the same external dimensions as the internal dimensions of the collar at the other end of the bobbin but is staggered radially inwards with respect to the yarn uptake, the collar being fitted with a yarn-reserve groove.

14 Claims, 7 Drawing Sheets

LAP CREEL

BACKGROUND OF THE INVENTION

The invention relates to a lap creel for receiving yarns, with rotationally symmetric bodies, whose exterior forms a surface supporting the yarn, with a collar projecting axially at one end, with a yarn bunching groove and a seat for the collar at the other end.

Lap creels of this type have been disclosed. These lap creels are provided with annular teeth at both ends, said teeth projecting in the axial direction. The radially outward surfaces of the teeth abut the surface of the lap creels supporting the yarn without a transition. The teeth located at one end of the lap creel are adjusted to fit the tooth spacing of the teeth at the other end. The surfaces supporting the yarn can be wound up to the area of the two sets of teeth and can cover a maximum of 50% of the total axial extent.

With axial stacking of two lap creels, the teeth, arranged annularly and opposite one another, mesh in the most favorable case, with the 50% of the teeth that are not wound being guided beneath the laps of the opposite lap creel. The laps on this creel therefore have their faces close together without any space. In this manner, slipping of the laps off the lap creel can he avoided during transport and use of the otherwise conventional intermediate disks or spacers covering the spaces can he eliminated. At the same time storage and shipping space are saved and, in the case of axial compression, assurance is provided that the pressure thus exerted is also effective between the laps, so that relative movements between the laps on the one hand and the lap creels on the other is practically eliminated. For dyeing it is also important to form a homogeneous yarn column of stacked lap creels, in which the laps have their faces pressed tightly together.

To improve the guidance between two axially adjacent lap creels, at one end of the lap creel a collar projecting axially beyond the teeth is provided on which a bunching groove can he provided and at the other end of the lap creel there is a seat adapted to the outer dimensions of the collar.

In known lap creels, despite the above-mentioned advantages, disadvantages are also clearly apparent. When the lap creels are wound, the bunching provided on the collar which is offset radially inward is wound first. The inside diameter of the lap creel however is smaller in this area than at the opposite end, which leads to problems in the creeling machines, which in the case of the other lap creels of the prior art, to the extent that these have a bunching groove, accept these at the end with the larger diameter. With such an arrangement however, the bunching groove cannot be made in a covered arrangement. If the bunching is wound on, the yarn thread must be guided onto the surface that supports the yarn and is located radially outward from the collar, in order to wind on this surface. Since the winding of the surface of the known lap creels that supports the yarn can cover only 50% of the axial distance of the teeth, a transitional area results which the thread must span by covering the remaining 50% of the teeth. In any case, with an axial stacking of adjacent lap creels and the meshing of the opposite teeth, squeezing or tearing of the thread coming from the bunching and hence a reduction in quality takes place, for example as a result of the defective dyeing that then occurs or leads to operating malfunctions when unwinding in the event of a break.

Since it is not possible for the teeth to grip below the opposite laps without tilting the lap creels, tilting of the teeth can also cause damage to the thread. The teeth also reduce the reliability of seating in the creeling device and permanent spreading can occur at this point so that when the wound lap creels are inserted into one another, the expanded teeth can penetrate the yarn. In order to wind such a sleeve, it is necessary to replace the take-up disks on winding machines by take-up disks with suitable dimensions because the known lap creel has the bunching at the end with the smaller inside diameter and hence inverted from the usual.

SUMMARY OF THE INVENTION

Hence the goal of the invention is to design a lap creel of the species described at the outset so that, while retaining the known advantages, axial stacking of the wound lap creels is possible without risk of damage to the thread or jamming.

This goal is achieved according to the invention by virtue of the fact that the lap creel has an additional collar at the end with the seat, said collar being offset radially inward with respect to the seat and corresponding in its external dimensions to the internal dimensions of the collar located at the other end, with the additional collar extending axially approximately up to the face of the seat or beyond.

Provision of the collar at both ends of the lap creel allows winding onto the surface supporting the yarn to take place up to the two ends of this surface. If two lap creels according to the invention are stacked axially with their collars facing one another, the additional collar of one lap creel can be inserted into the cylindrical inner surface of the other lap creel, whose collar simultaneously is guided into the seat located radially outward from the additional collar. This causes the opposite faces of adjacent laps to come into direct contact with one another. Mutual gripping of the laps by the abutting surfaces supporting the yarn is therefore not necessary and hence damage or jamming of the thread is eliminated. If these collars are designed to project axially, at the same time mechanical damage to the collar over which unwinding is taking place is avoided. The guidance conditions are improved and the bunching is protected against mechanical damage when inserting lap creels into one another. The additional collar also has a smaller inside diameter than the collar that has the bunching groove, so that there are no further problems with the creeling machines and machine conversion can be avoided. The existing takeup disks on the winding machines can continue to be used.

According to one embodiment of the invention provision is made such that each lap creel has a shoulder stop for a collar of an axially adjacent, preferably similar lap creel. This shoulder stop determines the depth to which the adjacent lap creel can he inserted into the seat with its collar. The depth can be set so that between the surfaces of the lap creels with their ends opposite one another and supporting the yarn, a small space remains as a gap. Since the surface of a lap creel supporting the yarn can be wound up to its two ends, the thread can be wound from the bunching mounted on the collar without a transition to this surface, so that when the collars of two similar lap creels associated with one another are fitted together axially, damage to or tearing of the thread is no longer possible. The space between the ends of the surfaces supporting the yarn that are axially opposite one another is dimensioned so that the thread coming from the bunching is guided between them without squeezing. However, the space is of no significance for the direct contact between the faces of adjacent laps.

Consequently, even in the lap creels according to the invention with axial stacking, as a result of the laps supporting one another by their faces, a homogeneous yarn column is formed that is protected against slippage of the lap creels, so that intermediate disks or spacers need not be used. In the case of axial compression of the lap creels, assurance is likewise provided that the pressure thus exerted also acts between the laps.

In addition, one embodiment of the invention provides that the surface supporting the yarn, in the area of at least one end, has means (8) for axial guidance of the thread, which can be designed as a groove. This groove, into which the thread is wound, also prevents the lap from sliding over the two ends of the surface supporting the yarn and off the lap creel.

Another embodiment of the invention provides for the outer envelope of the body of the lap creel to be designed to be conical, at least area wise.

As a result for example even closer packing of the laps is possible. As a result one can even pack more tightly than corresponds to the original width of the laps. Such a lap creel is unwound over the larger outside diameter.

Another embodiment of the invention provides that the collar and/or additional collar are each formed on an insert, each of which has an insert collar and is inserted by the latter into a corresponding inner surface of a lap creel. This makes design simpler and less expensive.

Finally, according to a design embodiment, provision is also made that the additional collar is formed by ribs, whose radially outer surfaces form a collar surface, with the ribs also possibly being directed radially. As a result, through-flow can be considerably improved in the overlap area. The lap creel proposed can be wound on its entire remaining circumferential surface and on the bunching groove.

BRIEF DESCRIPTION OF THE DRAWINGS

The invention will now be described in greater detail with reference to the attached drawings.

DETAILED DESCRIPTION

Figure 1:
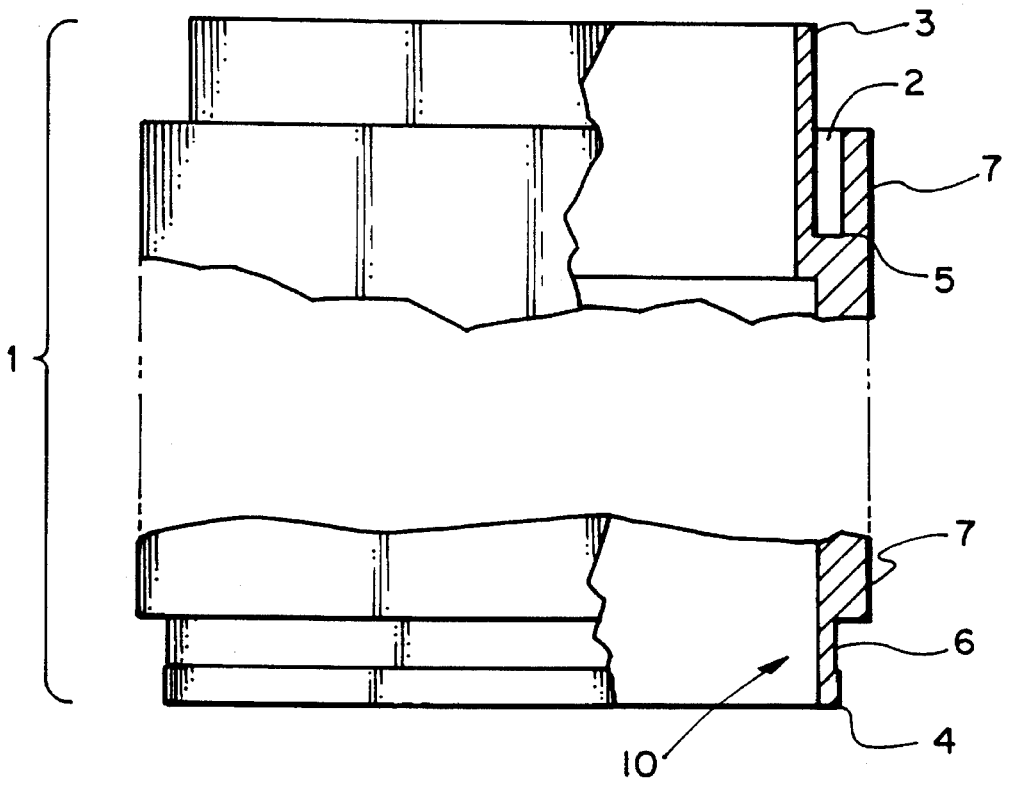
FIG. 1 is a lap creel in a side view and partial section.

FIG. 1 is a schematic representation of a lap creel 1 with an additional collar 3 located at one end and offset radially inward with respect to a seat 2. Additional collar 3 has its external dimensions adapted to the inside dimensions of a collar 4 and therefore, with a similar axially adjacent lap creel 1, can be inserted into the cylindrical inner surface 10 surrounded by collar 4. A shoulder stop 5 can be seen in seat 2 to receive the face of one end of a similar axially adjacent lap creel 1. As a result, the depth to which collar 4 can be inserted is determined, and is dimensioned so that a small space remains between the ends of surfaces 7 supporting the yarn, so that the thread guided from the bunching onto surface 7 supporting the yarn cannot be squeezed. The other end of lap creel 1 shown here has collar 4 with a bunching groove 6. The bunching that has been wound on when collar 4 is inserted into seat 2 is additionally protected by bunching groove 6. A portion of surface 7 supporting the yarn can be seen at both ends of lap creel 1.

Figure 2:
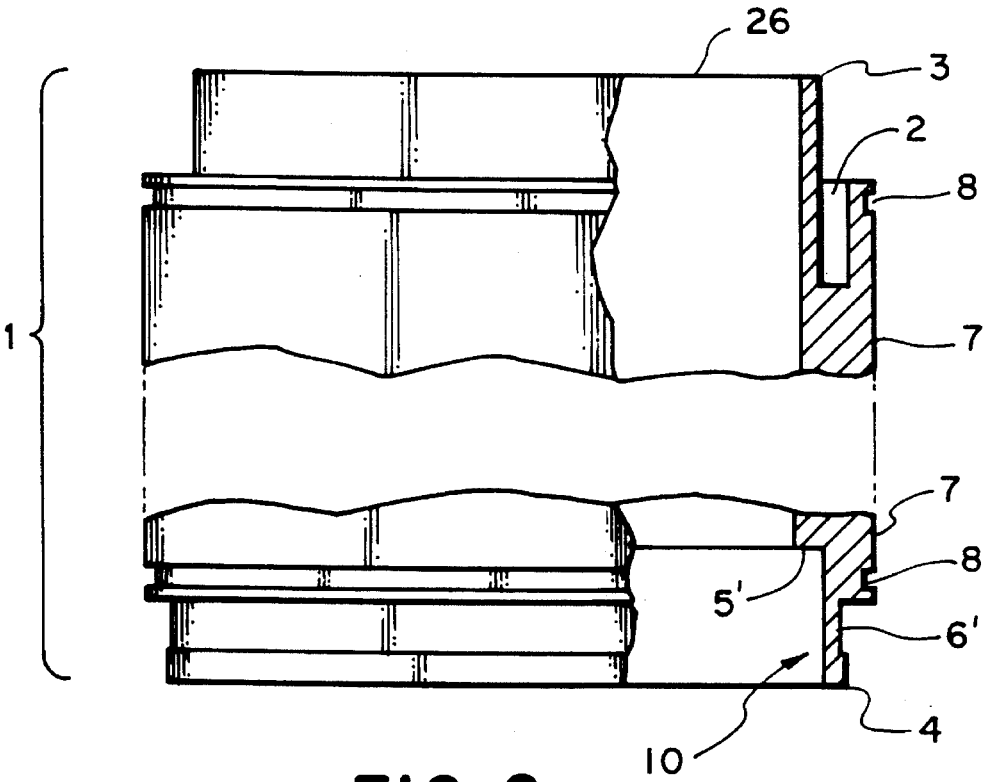
FIG. 2 is a variation in the same view as in FIG. 1.

FIG. 2 shows, likewise schematically, another embodiment of lap creel 1, but with grooves 8 located in the vicinity of the two ends of surface 7 supporting the yarn. Grooves 8 are wound with the yarn, so that the yarn is pressed into grooves 8 and thus prevents the lap from sliding off lap creel 1 over the ends of surface 7 supporting the yarn. In addition, shoulder stop 5' is displaced inward and into the vicinity of the end with collar 4, which now cooperates with face 26 of additional collar 3 of an axially adjacent sleeve.

Figure 3:
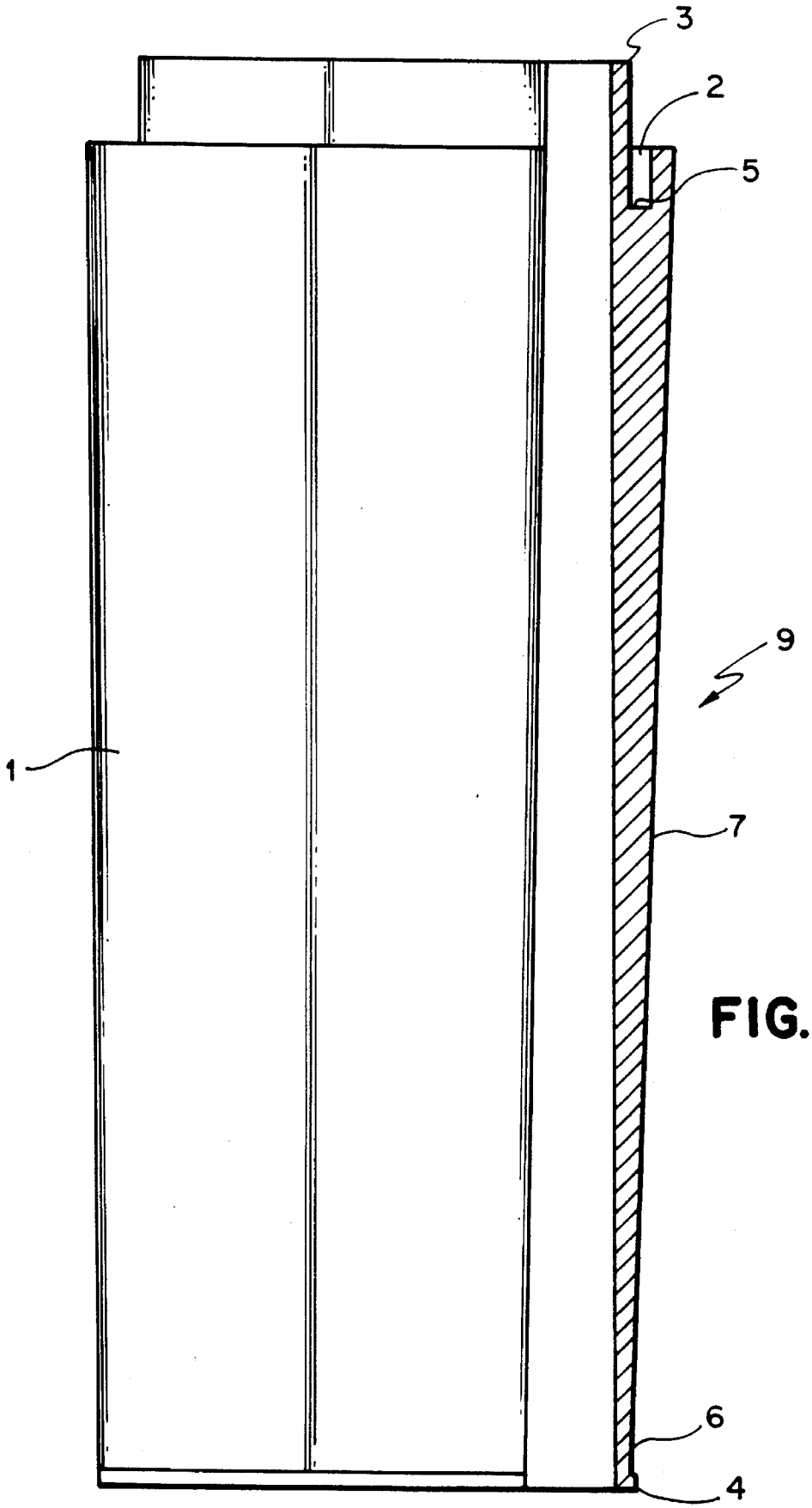
FIG. 3 is a side view of another variation, in partial section.

FIG. 3 also shows a schematic diagram of a lap creel 1, but with conically shaped body 9. This permits a closer packing of the lap creels 1. The diameter of lap creel 1 decreases toward collar 4, and surface 7 supporting the yarn makes a continuous transition thereto, so that the yarn coming from the bunching can be wound without a transition onto surface 7 supporting the yarn. The provision of a space between the ends of two axially adjacent surfaces 7 supporting the yarn by shoulder stop 5 or the penetration depth of collar 4 determined thereby may be eliminated since the ends of surface 7 supporting the yarn are not located opposite one another on a plane. The danger of squeezing the thread coming from the bunching therefore does not exist. The outside diameter of additional collar 3 located on one end and offset radially inward with respect to seat 2, in this design too corresponds to the inside diameter of collar 4 located at the other end, so that additional collar 3, with a similar axially adjacent lap creel 1, can be inserted into collar 4, so that the faces of opposite laps abut one another directly. Collar 4 can also be provided with a bunching groove 6.

Figure 4:
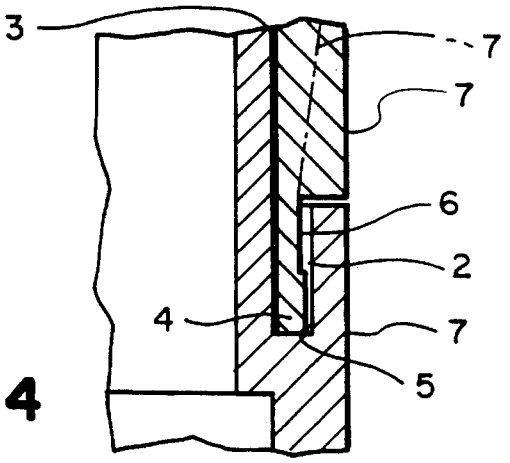
FIG. 4 is an enlarged section of the joint area between two lap creels fitted together.

FIG. 4 shows on an enlarged scale a section through a partial area of two lap creels 1, showing interlocking collars 3, 4 of two lap creels 1 located axially above or next to one another. Collar 4 of one of the lap creels 1 is introduced into seat 2 of the other lap creel and has its end abutting shoulder stop 5 in seat 2, so that with suitable dimensions, a small space can be produced between the axially adjacent ends of surface 7 supporting the yarn of the two lap creels, which permits a squeeze-free guidance of the yarn from the bunching or the bunching groove 6 to surface 7 supporting the yarn. This also applies to the embodiment according to FIG. 3, indicated by the dot-dashed line 7 in FIG. 4.

Figure 5:
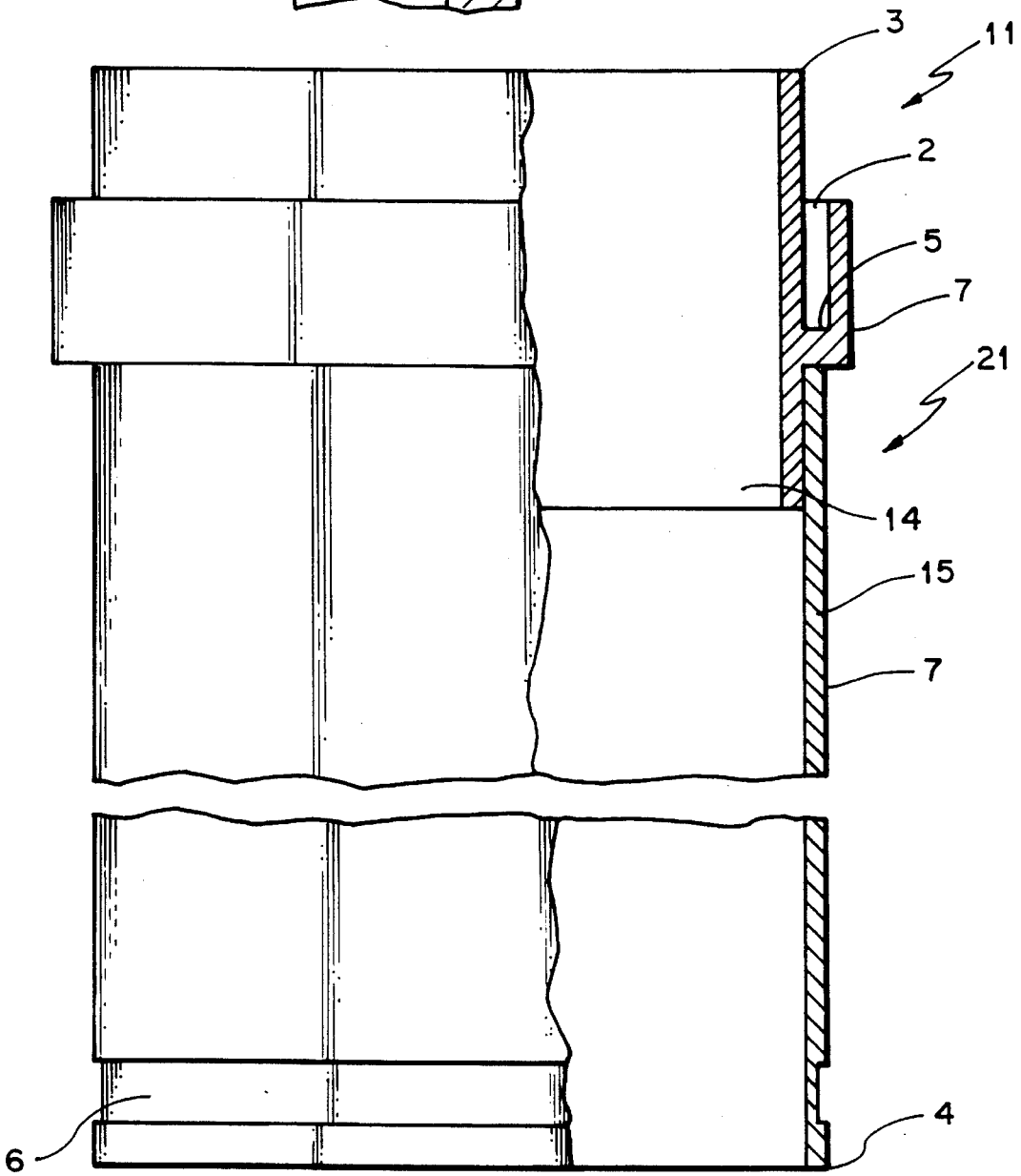
FIG. 5 is a lap creel with an insert in a side view and a partial section.

In the embodiment according to FIG. 5, a lap creel 21 consists of a bobbin or yarn carrier 15, which can be a cardboard tube for example, and an insert 11, which is inserted into bobbin 15 with an insertion collar 14. Insert 11 can therefore be removed and possibly reused. The additional collar 3 already described with respect to FIG. 1 and the seat 2 with shoulder stop 5 are formed on insert 11. Surface 7 supporting the yarn, in the embodiment shown in FIG. 5, as a result of the differences in diameter between the outside diameter of insert 11 and the outside diameter of bobbin 15, has a step which can be avoided by changing the thickness of the wall of bobbin 15, bobbin 16 in the embodiment shown in FIG. 6, as indicated in the design in FIG. 6.

Figure 6:
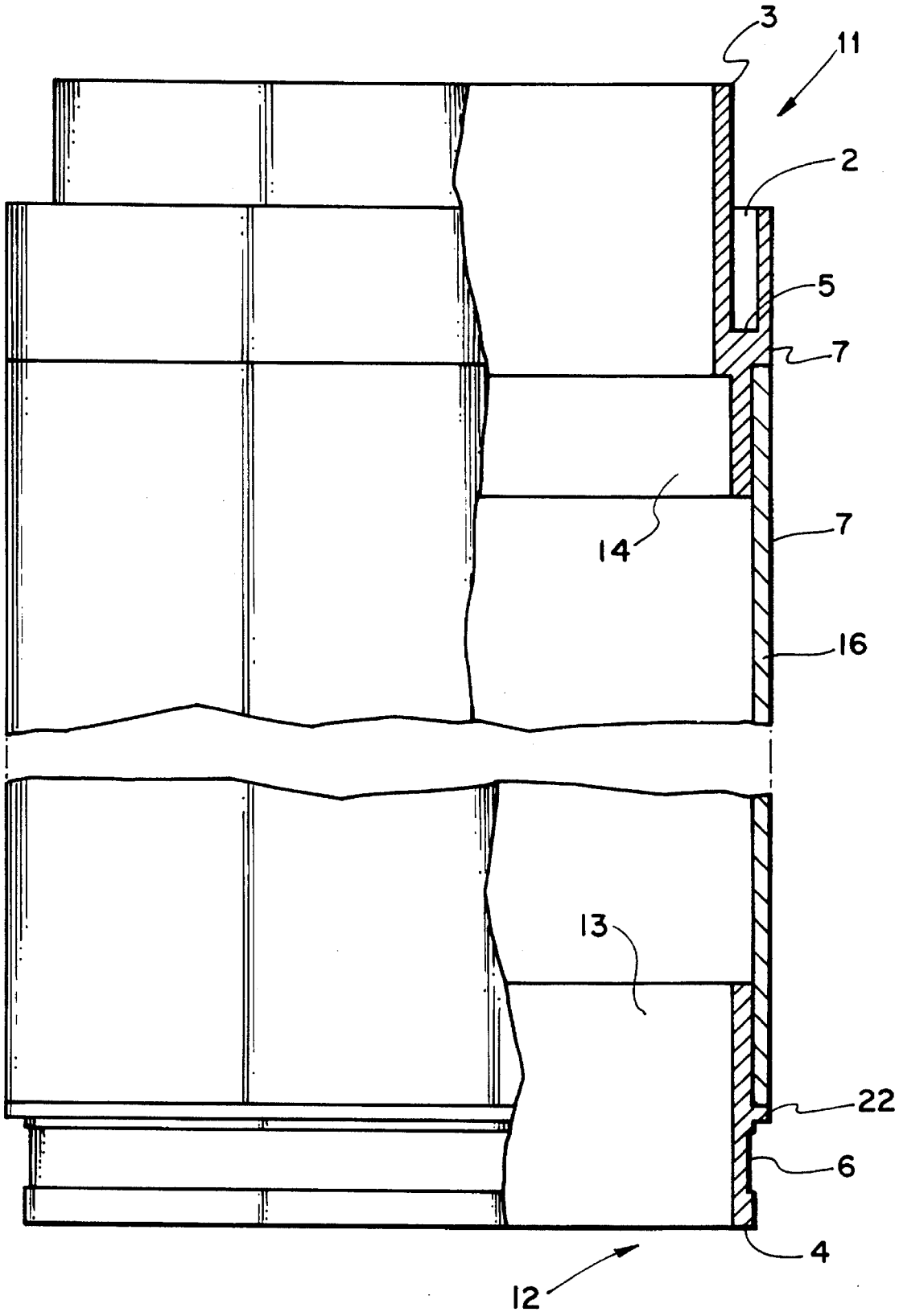
FIG. 6 shows a lap creel as in FIG. 5 but with inserts on both ends.

Because of the smaller diameter of bobbin 15 as shown in FIG. 5 with respect to the embodiment shown in FIG. 6, in an embodiment according to FIG. 5 it is possible to insert the free end of bobbin 15 into seat 2 of insert 11 so that a special design for the free end of bobbin 15 in the embodiment according to FIG. 5 is not required. Nevertheless, a bunching groove can be embossed there onto which a covered bunching can then be wound.

With the larger diameter of bobbin 16 in the embodiment according to FIG. 6, this is no longer possible so that in the latter, at the free end of bobbin 16, an insert 12 is again provided which can be inserted into bobbin 16 with an insert collar 13, as in the case of insert 11. Insert 12 has a collar 22 by which it abuts the face of bobbin 16 and whose diameter corresponds to the outside diameter of bobbin 16, so that the circumferential surface of collar 22 also becomes a surface 7 that supports the yarn. A collar 4 with a bunching groove 6 abuts this collar 22, as already described in the design according to FIG. 1. In the design according to FIG. 6 as well, insert 12 can be removed and possibly recycled. Inserts 11 and 12 however can also be glued into the associated bobbins 15 or 16 or they can be made of different materials.

Figure 7:
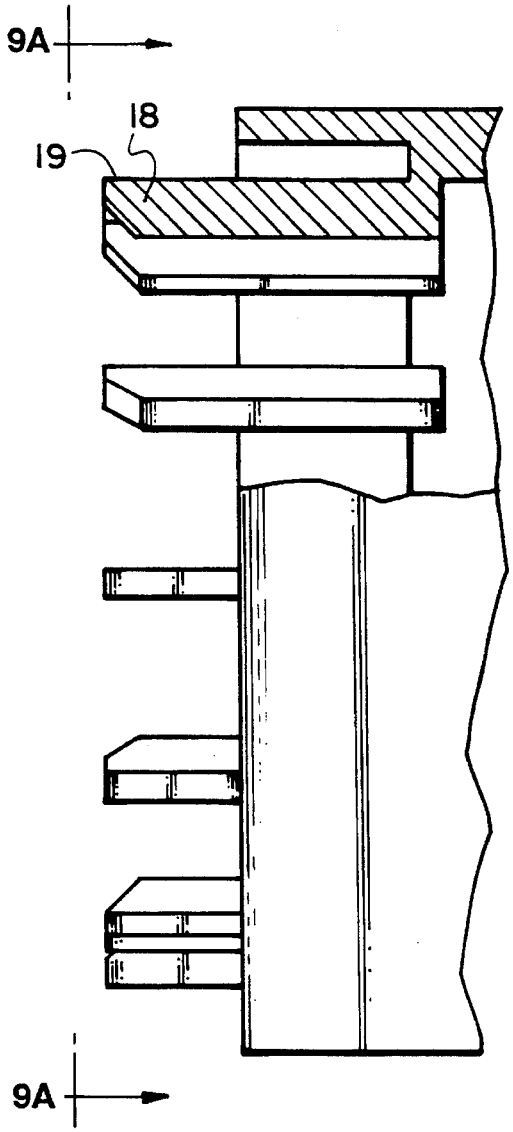
FIG. 7 is a schematic of an alternative collar with narrow radial ribs.
Figure 8:
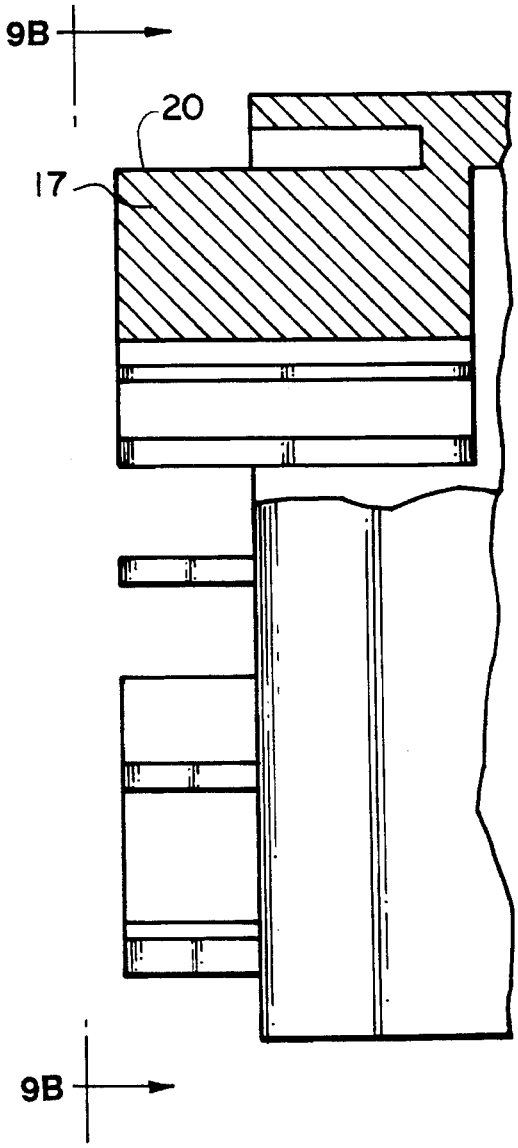
FIG. 8 is a schematic of an alternative collar with wide radial ribs.
Figure 9B:
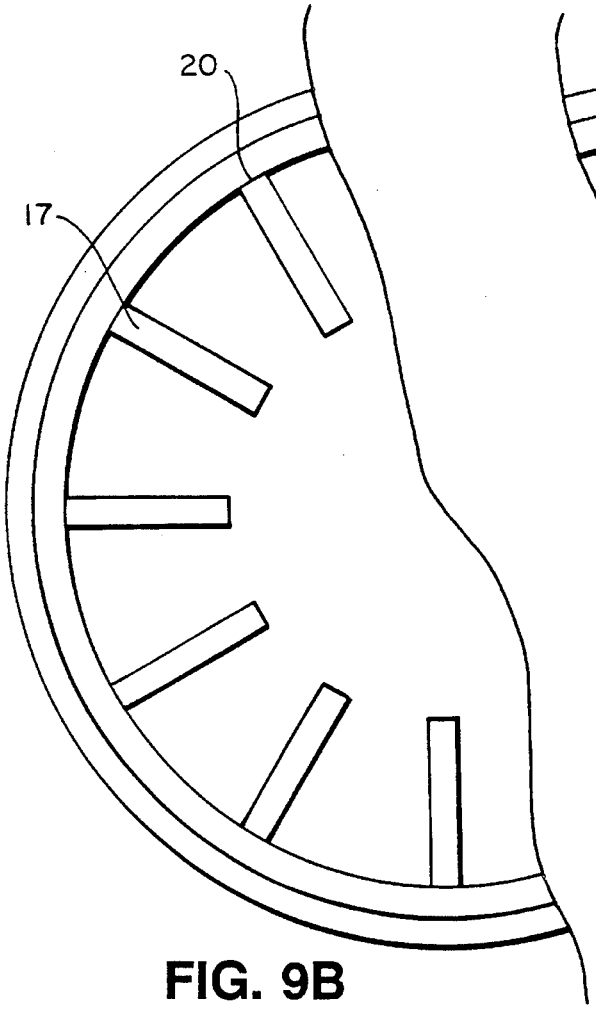
FIG. 9B is a schematic of a partial view along section lines 9B—9B in FIG. 8.
Figure 9A:
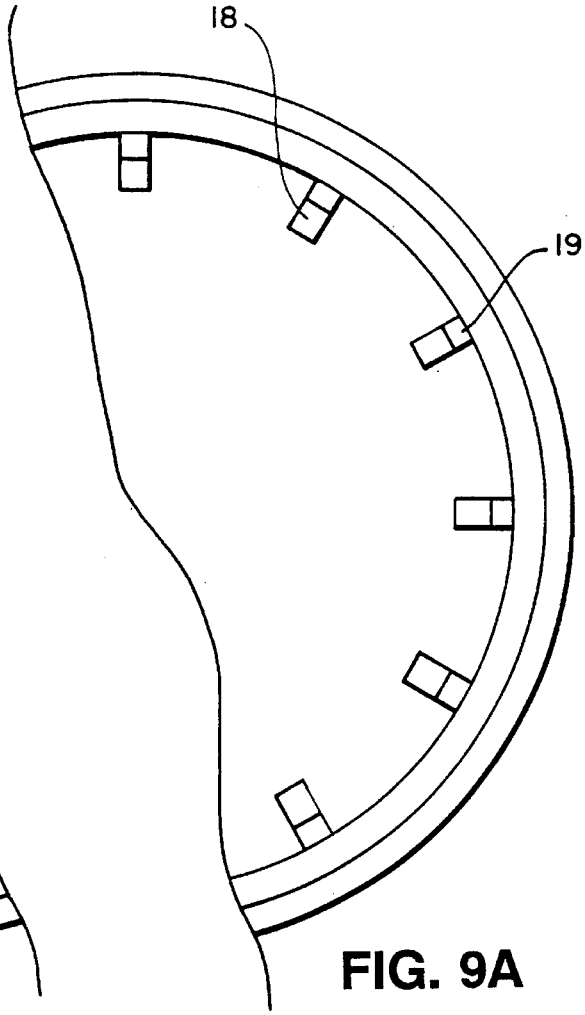
FIG. 9A is a schematic of a partial view along section lines 9A—9A in FIG. 7.

FIGS. 7 to 9 show modified designs of the additional collar 3 according to the previous embodiments in FIGS. 1 to 6. It should be noted that additional collar 3 need not necessarily be made in the form of a closed ring, but instead can consist of ribs 17 or 18 as shown in FIG. 8 and FIG. 7. Here FIG. 8 shows ribs 17 with a relatively large radial extent, while FIG. 7 shows ribs 18 with a relatively small radial extent. A corresponding end view that shows this radial extent clearly as well as the differences involved, is shown in FIGS. 9A and 9B. Here FIG. 9B shows view 9B—9B in FIG. 8 while FIG. 9A shows the view 9A—9A in FIG. 7. Ribs 17 and 18 have a radial external surface 19 or 20 which forms the outer surface of "additional collar 3" and which can be inserted for example into the cylindrical inner surface 10 of the embodiment shown in FIG. 1. Of course it is also possible to adopt this design, as shown in FIGS. 4 to 9, for insert 11 according to the embodiment shown in FIG. 5.

Figure 10:
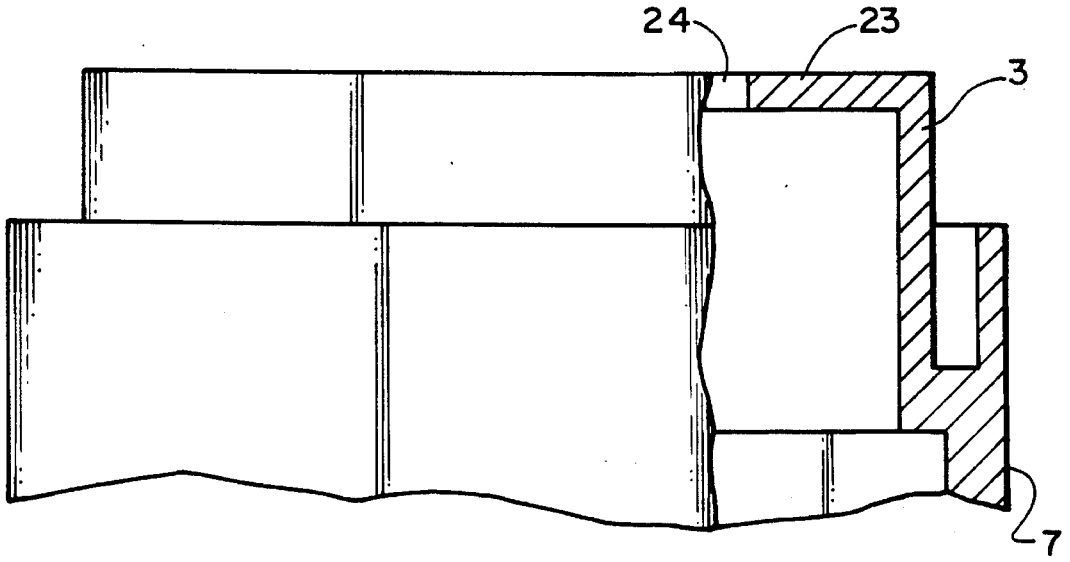
FIG. 10 is a schematic of an alternative collar with an annular radial inward extension.
Figure 11:
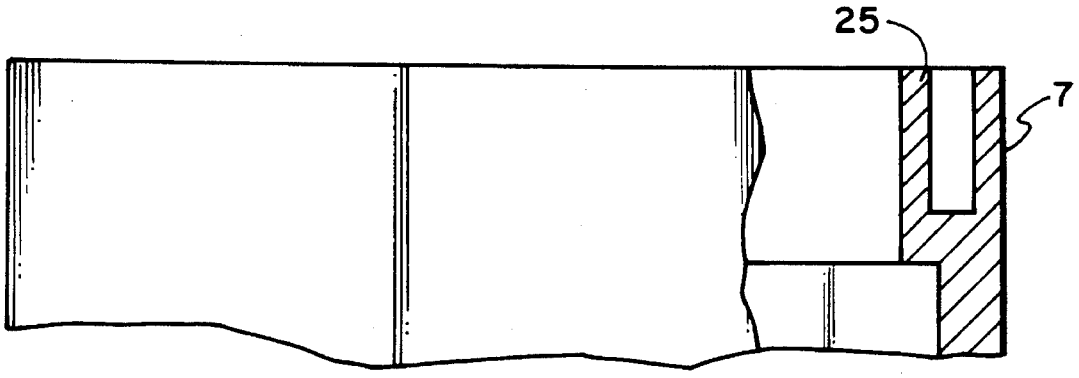
FIG. 11 is a schematic of an alternative short collar.
Figure 12:
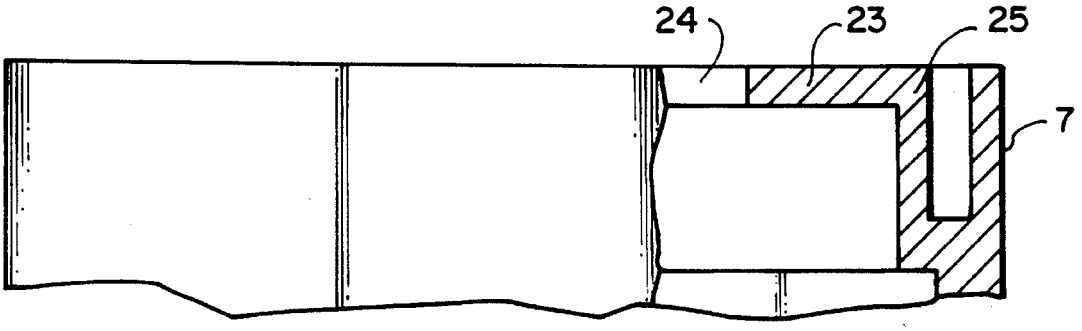
FIG. 12 is a schematic of an alternative short collar with an annular radial inward extension.

FIGS. 10 to 12 show modified embodiments of an insert 11 according to FIG. 6 or the corresponding end design of an embodiment according to FIG. 1. In the embodiment according to FIG. 10, an additional collar 3 has an annular collar 23 directed radially inward, which reliably prevents a (for example) partial deformation of additional collar 3 and whose concentrically arranged opening 24 serves as a seat for existing take-up disks on winding machines and as centering for existing dyeing spindles.

Additional collar 3 projecting axially, in addition to the favorable guidance length, has the further advantage that the bobbins can be placed on the face of this additional collar 3 during storage and transport, so that damage to the face of the surface supporting the yarn, with the risk of the thread breaking during the unwinding process, is avoided in this area. In the embodiments shown in FIGS. 11 and 12 this risk is taken into account. The additional collar 25 used therein is shorter than additional collar 3 and no longer, or only very slightly, projects beyond the face of surface 7 supporting the yarn. Nevertheless, by using the annular collar 23 already described with respect to FIG. 10 in the embodiment according to FIG. 12, the risk of damage can be reduced.

However, even in the embodiment in FIG. 11, the contact load is distributed over two faces, so that here again the risk of damage is reduced.

List of reference numerals

1. Lap creel
2. Seat
3. Additional collar
4. Collar
5, 5' Shoulder stop
6. Bunching groove
7. Surface supporting the yarn
8. Thread guidance means
9. Body
10. Inner surface
11. Insert
12. Insert
13. Insert collar
14. Insert collar
15. Bobbin
16. Bobbin
17. Ribs
18. Ribs
19. Radial outer surfaces
20. Radial outer surfaces
21. Lap creel
22. Collar
23. Annular collar
24. Opening
25. Additional collar
26. Face

We claim:

1. An axially stackable lap creel for yarn, said lap creel comprising a) a rotationally symmetrical body having an outer surface to support the yarn, said outer surface having an insertion end and a receiving end;

b) a first collar extending axially from the insertion end of said outer surface of said body, said collar comprising a bunching groove on an outer surface of said collar; and c) a seat located at the receiving end of said outer surface, said seat comprising (i) a shoulder stop arranged radially inwardly of said outer surface of said body, said outer surface extending axially beyond said shoulder stop to form an extension, and (ii) a second collar located radially inwardly of said shoulder stop and extending axially at least to the end of said extension;

wherein said seat is configured such that said first collar of a first lap creel can be inserted into the seat of a second, identical lap creel, and the axial dimension of the first collar is longer than the axial dimension of the extension, such that when a first collar of a first lap creel is inserted into a seat of a second lap creel, said bunching groove on said first collar is located radially inwardly of said extension, and a gap is formed between the insertion end of said outer surface of the first lap creel and the receiving end of the outer surface of the second lap creel.

2. A lap creel of claim 1 wherein said outer surface supporting the yarn comprises a groove for axially guiding the yarn, wherein said groove is located adjacent at least one end of said outer surface.

3. A lap creel of claim 2, wherein said outer surface comprises two grooves, a first groove being located adjacent said insertion end, and a second groove being located adjacent the end of said extension of said outer surface.

4. A lap creel of claim 1, wherein said outer surface is cone-shaped.

5. A lap creel of claim 4, wherein the diameter of said cone-shaped outer surface decreases from said receiving end to said insertion end.

6. A lap creel of claim 1, wherein said body comprises a yarn carrier and an insert comprising two ends, said insert comprising said first collar at one end and an insert collar at the other end, wherein said insert collar is sized to be inserted into a corresponding inner surface of said yarn carrier.

7. A lap creel of claim 1, wherein said body comprises a yarn carrier and an insert comprising two ends, said insert comprising said seat at one end and an insert collar at the other end, wherein said insert collar is sized to be inserted into a corresponding inner surface of said yarn carrier.

8. A lap creel of claim 1, wherein said body comprises a yarn carrier having two ends; and first and second inserts each comprising two ends;

said first insert comprising said first collar at one end and a first insert collar at the other end, wherein said first insert collar is sized to be inserted into a corresponding inner surface of a first end of said yarn carrier; and said second insert comprising said seat at one end and a second insert collar at the other end, wherein said second insert collar is sized to be inserted into a corresponding inner surface of a second end of said yarn carrier.

9. A lap creel of claim 1, wherein said second collar comprises radially extending ribs, whose radially outer surfaces comprise the external radius of said second collar.

10. A lap creel of claim 9, wherein said ribs are aligned radially.

11. A lap creel of claim 1, wherein said collar extends axially beyond said extension.

12. A lap creel of claim 11, wherein said second collar comprises an annulus extending radially inwardly from said second collar.

13. A lap creel of claim 1, wherein said second collar comprises an annulus extending radially inwardly from said second collar.

14. A method for useing the lap creel of claim 1, comprising the steps of providing said lap creel, and winding yarn on the entire outer surface of said lap creel including said extension and on said bunching groove.

* * * * *